US005611954A

United States Patent [19]

Wright

[11] Patent Number: 5,611,954

[45] Date of Patent: Mar. 18, 1997

[54] CONTAINER WITH MICROWAVE HEATABLE LINER FOR HEATING PRE-MOISTENED

[76] Inventor: Carolyn Wright, 1349 Palmetto Ave., Toledo, Ohio 43606

[21] Appl. No.: 532,078

[22] Filed: Sep. 22, 1995

[51] Int. Cl.[6] ..... H05B 6/80

[52] U.S. Cl. ..... 219/759; 219/734; 219/762

[58] Field of Search ..... 219/730, 759, 219/734, 762

[56] References Cited

U.S. PATENT DOCUMENTS

| | | | |
|---|---|---|---|
| 4,307,277 | 12/1981 | Maeda | 219/759 |
| 4,745,248 | 5/1988 | Hayes | 219/734 |
| 4,822,966 | 4/1989 | Matsubara | 219/759 |
| 4,882,463 | 11/1989 | Kyougoku et al. | 219/730 |
| 4,963,708 | 10/1990 | Kearns et al. | 219/730 |
| 4,983,798 | 1/1991 | Eckler et al. | 219/730 |
| 5,233,144 | 8/1993 | Marino et al. | 219/10.55 E |
| 5,260,536 | 11/1993 | Peery | 219/10.55 E |
| 5,369,256 | 11/1994 | Woods | 219/727 |
| 5,403,998 | 4/1995 | Sheen et al. | 219/730 |
| 5,493,103 | 2/1996 | Kuhn | 219/730 |

*Primary Examiner*—Philip H. Leung
*Attorney, Agent, or Firm*—Joseph N. Breaux

[57] ABSTRACT

A device and method for microwave heating of premoistened fabric sheets held within a microwave heatable container, the container retaining heat and moisture over a period of time is provided. The microwave heatable container comprises: a microwavable housing having a top border defining an upper opening, an exterior surface, and an interior surface; a microwave heatable liner in connection with the interior surface of the housing, the liner defining a cavity within the housing for disposing premoistened fabric sheets; and a lid having a bottom surface for closing the upper opening of the housing.

2 Claims, 1 Drawing Sheet

CONTAINER WITH MICROWAVE HEATABLE LINER FOR HEATING PRE-MOISTENED

TECHNICAL FIELD

The present invention relates to devices and methods for heating premoistened fabric sheets and more particularly to devices and methods for heating premoistened fabric sheets that has a microwave heatable container for holding the premoistened fabric sheets therein and to retain heat and moisture within the container.

BACKGROUND ART

After an infant has soiled his diaper it is common practice to clean the infant up using a premoistened diaper wipe. These premoistened wipes are at room temperature and when applied to the infant's warmer skin often startle the infant causing him to cry. Premoistened fabric sheets are also used by many elderly people, for which a warmer fabric sheet may be soothing.

It is common to warm an individual premoistened fabric sheet in a microwave before use. However, this practice results in drying of the sheet and the sheet quickly cools, often before it may be applied. It is also impractical to heat individual sheets for use in day care centers and nursing homes.

It would be a benefit, therefore, to have a container for heating a stack of premoistened fabric sheets in a microwave oven. It would be a further benefit, to have a container that allows for indirect heating of premoistened sheets preventing the drying of the sheets. It would be an additional benefit, to have a container which retains heat therein for a period of time. It would be a still further benefit, to have a container that retains heat and moisture therein.

GENERAL SUMMARY DISCUSSION OF INVENTION

It is thus an object of the invention to provide a microwave heatable container that has a microwavable housing for disposing premoistened fabric sheets therein for warming.

It is a further object of the invention to provide a microwave heatable container that has a microwave heatable liner which retains heat for a period of time.

It is a still further object of the invention to provide a microwave heatable container that has a removable lid which when closed over an upper opening in the housing retains heat and moisture within the housing.

Accordingly, a microwave heatable container of the type for microwave heating of premoistened fabric sheets held therein, the container retaining heat and moisture over a period of time is provided. The microwave heatable container comprises: a microwavable housing having a top border defining an upper opening, an exterior surface, and an interior surface; a microwave heatable liner in connection with the interior surface of the housing, the liner defining a cavity within the housing for disposing premoistened fabric sheets; and a lid having a bottom surface for closing the upper opening of the housing.

The housing may be constructed of any material which is microwave safe such as glass, ceramic or plastic. Preferably, the housing is constructed of material which is heat resistant so that the exterior surface remains cool to the touch. The housing may be constructed in various geometric shapes.

Preferably, the housing is generally rectangular for disposing standard commercially available premoistened fabric sheets or diaper wipes.

The upper opening provides access to a chamber defined by the internal surface of the housing. The chamber is sized to accommodate the liner and a stack of premoistened fabric sheets. The exterior surface of the housing may have indicia thereon indicating the contents of the container, or other logos or decorations.

The microwave heatable liner may be made of any material which is directly heatable by microwaves. Preferably, the liner is a liquid filled bag such as are commonly found for heating and applying to sore muscles. The liner may cover the entire interior surface of the housing. The liner may only cover a portion of the interior surface.

The heatable liner may include individual packs that are connectable to the sidewalls and the bottom of the housing. The individual packs may be connected by gluing or by cooperating hook and loop fasteners connected to the packs and to the internal surface of the housing.

The liner may be formed in a single pack shaped to fit within the chamber of the housing. The single liner may be loosely disposed within the chamber or connected to the internal surface of the housing by gluing or by cooperating hook and loop fasteners connected to the packs and to the internal surface of the housing.

The lid is constructed of the same material as the housing. The lid is sized to completely enclose the upper opening of the housing. The lid may be hingedly connected to the housing by a microwave safe hinge or be a removable piece.

Preferably, the lid sealingly closes the upper opening to retain heat and moisture within the cavity holding the premoistened fabric sheets. A lip member may extend from the bottom surface of the lid for disposing into the upper opening and contacting the internal surface of the housing. A portion of the outer edge of the lid may be disposable within the upper opening to form a seal between the lid and housing. Preferably, the lip member is formed by a top liner made of the same material as the liner disposed within the housing chamber.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
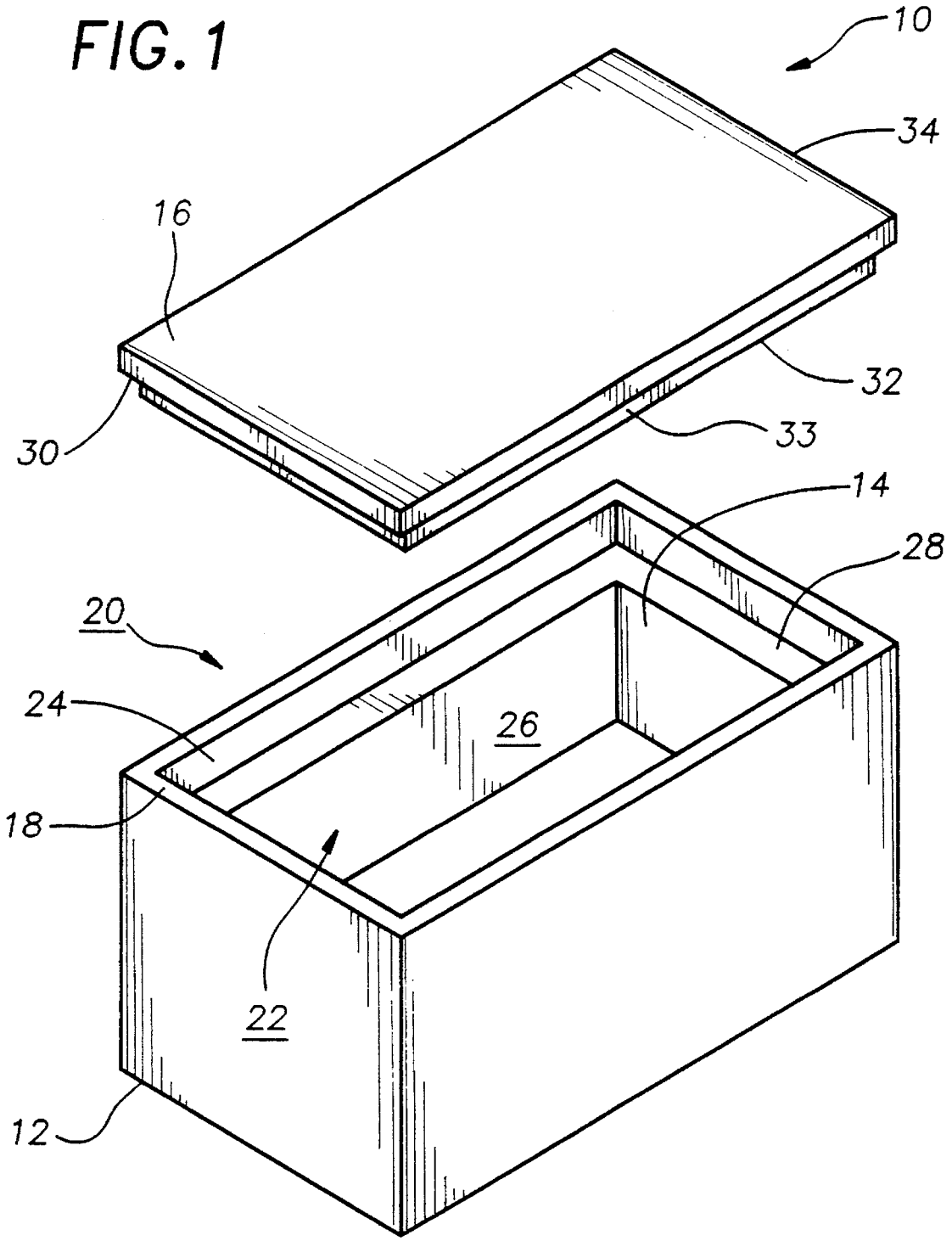
FIG. 1 is an isometric view of an exemplary embodiment of the microwave heatable container of the present invention.

FIG. 1 is an isometric view of an exemplary embodiment of the microwave heatable container of the present invention generally designated by the numeral 10. Container 10 comprises a housing 12, a microwave heatable liner 14 and a lid 16.

Housing 12 is constructed of a microwave transparent, heat resistant plastic. Housing 12 has a top border 18 defining an upper opening 20 into a chamber 22 defined by the interior surface 24 of housing 12. Chamber 22 is sized to dispose liner 14 and premoistened fabric sheets such as diaper wipes (not shown).

Microwave heatable liner 14 is a liquid filled plastic pack of the type available for heating in a microwave and applying to a person's body. Liner 14 has the property of maintaining heat for long period of time. Liner 14 is connected to interior surface 24 of housing 12 by gluing in a manner defining a cavity 26. Cavity 26 is sized to dispose a stack of premoistened diaper wipes for heating. The top edge 28 of liner 14 is recessed from the top border 18 of housing 12.

Lid 16 has a bottom surface 30 and is constructed of the same material as housing 12. Lid 16 is sized to match top border 18 of housing 12. A microwave heatable top liner 32 is connected to bottom surface 30 by gluing. Top liner 32 is recessed a distance from the outer edge 34 of lid 16 so as to be snugly disposable within upper opening 20, the outer periphery 33 of top liner 32 contacting internal surface 24 forming a seal between housing 12 and lid 16. When lid 16 is placed atop housing 12 top liner 32 contacts top edge 28 of liner 14 completely enclosing cavity 26 thereby retaining the heat and moisture in the cavity holding the premoistened fabric sheets.

Use of the microwave heatable container is now described with reference to FIG. 1. A stack of premoistened diaper wipes (not shown) are placed within cavity 26 formed by liner 14. Lid 16 is placed atop housing 12, disposing top liner 32 through upper opening 20 completely enclosing the diaper wipes within cavity 26. Container 10 is then placed in a microwave oven and heated for a short period. The microwave oven directly heats liner 14 and top liner 32 thereby indirectly heating the diaper wipes.

Lid 16 sealingly closes upper opening 20 by snugly disposing top liner 32 within upper opening 20. This sealed closure retains heat within container 10 and prevents drying of the diaper wipes. As a diaper wipe is needed, lid 16 is removed, a diaper wipe is retrieved and lid 16 is replaced to prevent the loss of heat.

It can be seen from the preceding description that a method and device for heating premoistened fabric sheets which has a microwavable housing for disposing premoistened fabric sheets therein for warming, has a microwave heatable liner which retains heat for a period of time, and has a removable lid which when closed over an upper opening in the housing retains heat and moisture within the housing has been provided.

It is noted that the embodiment of the microwave heatable container described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A microwave heatable container comprising:

a microwavable housing constructed of a microwave transparent, heat resistant plastic having a top border defining an upper opening, an exterior surface, and an interior surface;

a microwave heatable liner adhesively secured to said interior surface of said housing, said liner defining a cavity within said housing for disposing premoistened fabric sheets, said microwave heatable liner being a liquid filled plastic bag;

a microwavable lid constructed of a microwave transparent, heat resistant plastic having a bottom surface for closing said upper opening of said housing; and a microwave heatable top liner adhesively secured to said bottom surface of said lid, said top liner being recessed from an outer edge of said lid in a manner to be snugly disposable within said upper opening of said housing and in contact with a top edge of said liner in a manner to completely enclose said cavity when said lid is placed atop said housing and to form a seal between said lid and said housing for retaining heat and moisture within said cavity for disposing said premoistened fabric sheets, said top liner being a liquid filled plastic bag.

2. The microwave heatable container of claim 1, wherein:

said external surface of said housing has labeling indicia thereon.

* * * * *